US008567046B2

(12) United States Patent
Prabhakaran et al.

(10) Patent No.: US 8,567,046 B2
(45) Date of Patent: Oct. 29, 2013

(54) METHODS FOR MAKING MAGNETIC COMPONENTS

(75) Inventors: Satish Prabhakaran, Albany, NY (US); John Stanley Glaser, Niskayuna, NY (US); Ljubisa Dragoljub Stevanovic, Clifton Park, NY (US); Juan Manuel Rivas Davila, Niskayuna, NY (US)

(73) Assignee: General Electric Company, Niskayuna, NY (US)

( * ) Notice: Subject to any disclaimer, the term of this patent is extended or adjusted under 35 U.S.C. 154(b) by 931 days.

(21) Appl. No.: 12/632,084

(22) Filed: Dec. 7, 2009

(65) Prior Publication Data

US 2011/0133874 A1 Jun. 9, 2011

(51) Int. Cl.
*H01F 7/06* (2006.01)

(52) U.S. Cl.
USPC ..... 29/607; 29/592.1; 29/605; 29/606; 156/185; 156/247; 336/200

(58) Field of Classification Search
USPC ..... 29/25.42, 592.1, 605–607; 156/185, 156/247, 60; 336/200; 427/104
See application file for complete search history.

(56) References Cited

U.S. PATENT DOCUMENTS

| | | | | |
|---|---|---|---|---|
| 3,668,589 | A | 6/1972 | Wilkinson | |
| 4,639,707 | A | 1/1987 | Tanaka et al. | |
| 5,165,162 | A | 11/1992 | Charles | |
| 5,739,738 | A | 4/1998 | Hansen et al. | |
| 6,181,130 | B1 | 1/2001 | Hoshi et al. | |
| 6,320,490 | B1 | 11/2001 | Clayton | |
| 6,512,438 | B1 * | 1/2003 | Yoshimori et al. | 336/178 |
| 6,718,625 | B2 * | 4/2004 | Ito et al. | 29/606 |
| 6,990,729 | B2 | 1/2006 | Pleskach et al. | |
| 7,116,206 | B2 | 10/2006 | Ames et al. | |
| 7,158,005 | B2 | 1/2007 | Pleskach et al. | |
| 2004/0227516 | A1 * | 11/2004 | Endt | 324/318 |
| 2008/0075975 | A1 | 3/2008 | Glaser et al. | |
| 2008/0310051 | A1 | 12/2008 | Yan et al. | |

OTHER PUBLICATIONS

S. Lu et al., "30-MHz Power Inductor Using Nano-Granular Magnetic Material," Power Electronics Specialists Conference, 2007. PESC 2007. IEEE, pp. 1773-1776, Jun. 17-21, 2007.

M. Sippola et al., "New winding method for common mode choke," Proceedings of the 6th Biennal Conference on Electronics and Microsystems Technology, Oct. 7-9, 1998, pp. 49-52.

Sullivan, C.R.; Weidong Li; Prabhakaran, S.; Shanshan Lu, "Design and Fabrication of Low-Loss Toroidal Air-Core Inductors," Power Electronics Specialists Conference, 2007. IEEE , Jun. 17-21, 2007, pp. 1754-1759.

S.C. Tang et al., "Coreless Planar Printed-Circuit-Board (PCB) Transformers—A Fundamental Concept for Signal and Energy Transfer," IEEE transactions on power electronics, vol. 15, No. 5, Sep. 2000, pp. 931-941.

(Continued)

*Primary Examiner* — Paul D Kim
(74) *Attorney, Agent, or Firm* — Scott J. Asmus

(57) ABSTRACT

A method for making a magnetic component is provided. The method comprises providing a core with one or more ridges protruding from one or more surfaces of the core, depositing one or more electrically conductive materials on the core, and removing at least a portion of the one or more ridges to form one or more continuous conductors wound around the core. Each of the one or more continuous conductors defines at least one insulating gap. Further, a magnetic component and methods for making the magnetic component are also presented.

15 Claims, 5 Drawing Sheets

(56) References Cited

OTHER PUBLICATIONS

J. M. Rivas et al., "Design Considerations for Very High Frequency dc-dc Converters," 37th IEEE Power Electronics Specialists Conference, 2006, pp. 1-11.

J. Phinney et al., "Multi-resonant Microfabricated Inductors and Transformers," Power Electronics Specialists Conference, 2004, 35th IEEE, pp. 4527-4536.

T. Suetsugu and M. K. Kazimierczuk, "Integrated class DE synchronized dc-dc converter for on-chip power supplies," in 37th IEEE Power Electronics Specialists Conference, 2006.

Hui, S.Y.; Tang, S.C.; Chung, H.S.-H., "Some electromagnetic aspects of coreless PCB transformers," Power Electronics, IEEE Transactions on , vol. 15, No. 4, pp. 805-810, Jul. 2000.

Tang, S.C.; Hui, S.Y.; Chung, H.S.-H., "Characterization of coreless printed circuit board (PCB) transformers," Power Electronics, IEEE Transactions on , vol. 15, No. 6, pp. 1275-1282, Nov. 2000.

Mark Seitz and Michael Roeber, "Squeeze more performance out of toroidal inductors," Power Electronics Technology Magazine, pp. 302-333, Aug. 2005.

* cited by examiner

METHODS FOR MAKING MAGNETIC COMPONENTS

BACKGROUND

This invention relates generally to magnetic components and methods for making the magnetic components.

Magnetic components, such as inductors or transformers, are important components in many electrical circuits for supplying powers to different parts in the electrical circuits. Magnetic components typically comprise at least one coiled electrical conductor of at least one turn and at least two terminals to allow connection to an electrical circuit. Inductors and transformers have similar structures and differ in that an inductor generally provides an energy storage function, and a transformer generally provides an isolation and/or voltage step up/down function and includes at least one coil with two end terminals and at least one intermediate tap terminal, and two or more electrically isolated conductors wound around a core. The energy storage and transformation functions may be combined together to form a coupled inductor.

During operation, in order to achieve better performance, it is advantageous that the inductors or the transformers have a higher quality factor "Q" and lower flux leakage. However, in current applications, many inductors or transformers are formed via winding wire conductors around a core, which have poor fill factor and result in a lower quality factor. Furthermore, costs for fabricating such inductors or transformers may be also higher.

Therefore, there is a need for a new and improved method for making magnetic components having a higher quality factor and lower flux leakage.

BRIEF DESCRIPTION

A method for making a magnetic component is provided in accordance with one embodiment of the invention. The method comprises providing a core with one or more ridges protruding from one or more surfaces of the core, depositing one or more electrically conductive materials on the core, and removing at least a portion of the one or more ridges to form one or more continuous conductors wound around the core, wherein each of the one or more continuous conductors defines at least one insulating gap.

A magnetic component is provided in accordance with another embodiment of the invention. The magnetic component comprises a first part comprising one or more first substrates and a plurality of first electrically insulated conductors disposed on the one or more first substrates. The magnetic component further comprises a second part comprising one or more second substrates and one or more second electrically insulated conductors disposed on the one or more second substrates. The one or more second conductors are configured to electrically connect respective adjacent ones of the first electrically insulated conductors to one another to form one or more continuous wound conductors.

Another aspect of the invention further provides a method for making a magnetic component. The method comprises providing one or more first substrates, disposing one or more first electrically conductive materials on the one or more first substrates to form a plurality of first electrically insulated conductors on the one or more first substrates. The method further includes providing one or more second substrates and disposing one or more second electrically conductive materials on the one or more second substrates to form one or more second electrically insulated conductors on the one or more second substrates. The method further includes mating the one or more second substrates and the respective one or more first substrates, so that the one or more second conductors electrically connect respective adjacent ones of the first electrically insulated conductors to one another to form one or more continuous wound conductors.

A method for making a magnetic component is provided in accordance with yet another embodiment. The method comprises providing an electrical conductor which defines a recess having a lower side that faces away from the recess, adhering the lower side of the electrical conductor to a substrate, selectively removing portions of the electrical conductor to define a plurality of first electrically insulated conductors, disposing one or more second electrically conductive materials on a second substrate to form one or more second electrically insulated conductors, and mating the substrate with the second substrate so that the one or more second conductors electrically connect respective adjacent ones of the first electrically insulated conductors to one another to form one or more continuous wound conductors.

A method for making a magnetic component is provided in accordance with yet another embodiment. The method comprises providing a substrate which defines a recess, wherein the substrate comprises at least one electrically insulating material, selectively disposing a plurality of curved first electrical conductors within the recess to form a plurality of first electrically insulated conductors, disposing one or more second electrically conductive materials on a second substrate to form one or more second electrically insulated conductors, and mating the substrate with the second substrate so that the one or more second conductors electrically connect respective adjacent ones of the first electrically insulated conductors to one another to form one or more continuous wound conductors.

BRIEF DESCRIPTION OF THE DRAWINGS

The above and other aspects, features, and advantages of the present disclosure will become more apparent in light of the subsequent detailed description when taken in conjunction with the accompanying drawings in which.

DETAILED DESCRIPTION OF THE INVENTION

Embodiments of the present disclosure are described herein with reference to the accompanying drawings. In the subsequent description, well-known functions or constructions are not described in detail to avoid obscuring the disclosure in unnecessary detail.

Figure 1:
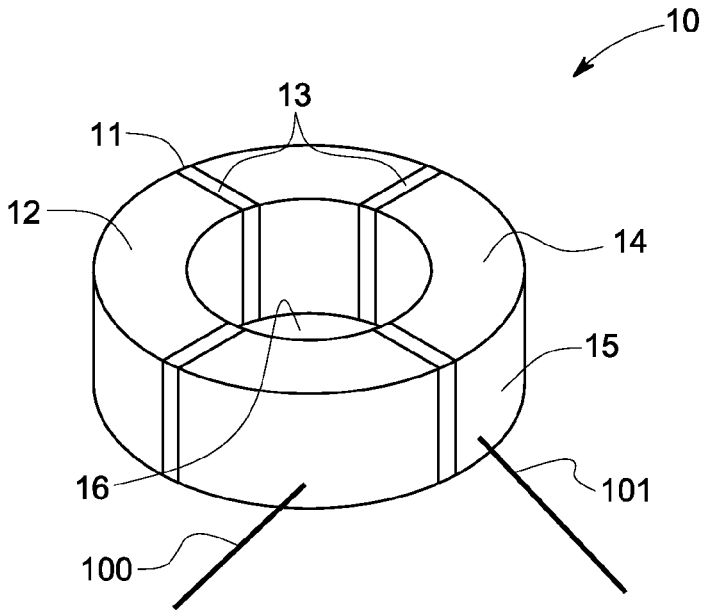
FIG. 1 is a schematic diagram of a magnetic component in accordance with one embodiment of the invention.

FIG. 1 is a schematic diagram of a magnetic component 10, such as an inductor, in accordance with one embodiment of the invention. As illustrated in FIG. 1, the magnetic component 10 comprises a core 11, a continuous conductor 12 and a continuous insulating gap 13 extending around the core 11. A positive terminal 100 and a negative terminal 101 are connected an electrical circuit (not shown) and two electrically insulated ends (not labeled) of the continuous conductor 12 for passing an electrical current through the continuous conductor 12.

For the illustrated arrangement, the core 11 comprises an upper surface 14, a lower surface (not labeled), and inner and outer side surfaces 15. The conductor 12 and the insulating gap 13 continuously extend around the upper, lower, and inner and outer side surfaces of the core 11 in a desired pattern, such as in the form of strip.

In the illustrated example, the core 11 has a toroidal shape with a rectangular cross section and defining a through hole 16. In other examples, the core 11 may have other shapes, such as a rectangular or a cylindrical shape. In some non-limiting examples, the toroidal core 11 may have other cross sections, such as a cylindrical or a polygonal cross section. In one non-limiting example, the core 11 has a cylindrical cross section and defines one cylindrical surface.

In some applications, the core 11 may comprise one or more electrically insulating and non-magnetic materials. Non-limiting examples of the one or more electrically insulating and non-magnetic materials include polymers, ceramics, and other suitable materials including air, Teflon®, epoxy and glass-epoxy composites, and combinations thereof. Teflon® is a registered trademark belonging to E.I. duPont de Nemours & Co., Inc. In some examples, the polymer may comprise polyethylene terephthalate (PET), polythene (PE), polypropylene (PP), poly(vinylidenechloride) (PVC), and combinations thereof.

In some embodiments, the conductor 12 may comprise one or more electrically conductive materials. Non-limiting examples of the one or more electrically conductive materials include gold, copper, silicon, platinum, silver, titanium, and other electrically conductive materials based carbon fibers, such as polyacronitrile (PAN) based carbon fibers. In some applications, the conductor 12 may be in the form of film. It should be noted that the term "film" may be similar to the meaning of "layer," "sheet," "plate," or "slice," and may not indicate a particular thickness of the material. In one non-limiting example, the conductor 12 comprises a copper film.

Additionally, the conductor 12 may be deposited on the core 11 using any of a variety of techniques including, but not limited to electroplating, powder pressing, sputtering, and evaporation. In non-limiting examples, the conductor 12 may be stamped around the core 11.

Figure 2:
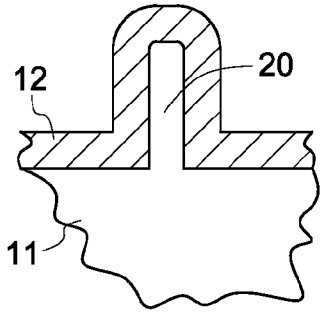
FIGS. 2-4 are schematic cross sectional views of the magnetic component shown in FIG. 1 for illustrating formation of an insulating gap.
Figure 3:
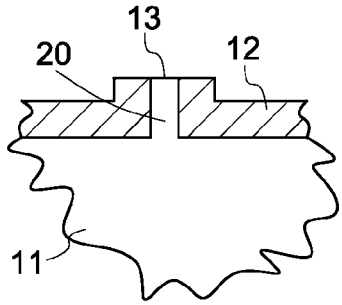
Figure 4:
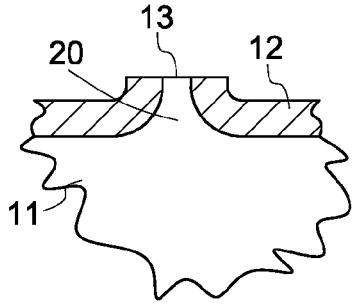

For certain arrangements, one or more ridges (20 in FIG. 2) protrude from the surface(s) of the core 11 for formation of one or more continuous insulating gaps 13 and one or more continuous conductors 12. FIGS. 2-4 are cross sectional views of the magnetic component 10 illustrating formation of the insulating gap 13. It should be noted that the arrangements in FIGS. 1-4 are merely illustrative. The same numerals in FIGS. 1-6 may indicate similar elements.

As depicted in FIG. 2, a ridge 20 protrudes from the respective surfaces of the core 11. In some applications, the ridge 20 may be formed with the core 11 simultaneously or separately, and may be disposed on the core 11 using any of a variety of techniques including, without limitation, molding, photolithography, machining, and other additive or subtractive techniques suitable for formation of the ridge 20 on the core 11.

In the illustrated example, the ridge 20 is continuously disposed on the upper, lower and side surfaces of the core 11, and has a rectangular cross section. In certain examples, the ridge 20 may have other cross sections, such as a trapezoidal cross section, as illustrated in FIG. 4. In one non-limiting example, the radius of corner(s) where the ridge 20 intersects the core 11 may be selected so as to reduce eddy current losses.

Accordingly, in non-limiting examples, during fabrication of the magnetic component 10, the ridge 20 is first disposed (wound) around the core 11. Then, one or more electrically conductive materials (not labeled) are deposited on all the surface(s) the core 11 with the ridge 20 thereon. Finally, as illustrated in FIG. 3 and/or FIG. 4, at least a portion of the ridge 20 is removed. Thus, the insulating gap 13 and the conductor 12 are formed around the core 11 in a desired pattern, such as in the form of strip after the removal of the at least a portion of the ridge 20.

In the illustrated example, the ridge 20 is a single continuous element, so that the insulating gap 13 and the conductor 12 each take the form of a respective, single continuous strip wound around the core 11, respectively. In other examples, more than one continuous ridge 20 may be wound around the core 11 in desired patterns.

Thus, the magnetic component 10 may comprise more than one continuous insulating gap and more than one electrically isolated continuous conductor wound around the core 11, which is similar to a transformer. Each continuous conductor may comprise at least one continuous turn. In other examples, one or more additional magnetic components (not shown) may also be provided for location into the through hole 16 (shown in FIG. 1). These additional magnetic components have similar structures as and cooperate with the magnetic component 10, for example, without limitation, to form a transformer. In non-limiting examples, the magnetic component may comprise a plurality of winding layers.

Similar to the terminals 100, 101 shown in FIG. 1, for some arrangements, two ends of each of the one or more continuous conductors may be also connected to respective positive and negative terminals of an electrical circuit (not shown).

In certain applications, the one or more ridges 20 may be unitary with the core 11 and may be removed from the core 11 using any of a variety of techniques including, without limitation, mechanical machining, abrasive removal, and laser cutting. In other applications, the one or more ridges may be detachably disposed around the core 11, so that the one or more ridges may be detached from the core 11 to form one or more continuous conductors in the desired pattern after the one or more electrically conductive materials are deposited on all the surface(s) of the core 11.

For some arrangements, the core 11 may be unitary, and the one or more continuous conductors extend around the core 11. In other applications, the core 11 may be segmented into more than one segment, and each segment may comprise one or more continuous conductors wound thereon. The one or more continuous conductors extending around respective segments may or may not be electrically connected. In certain applications, the core may comprise a transformer or an inductor.

The core 11 may comprise electrically insulating and non-magnetic materials. The ridges 20 may comprise electrically insulating materials, such that the gap(s) 13 is (are) insulated. In other non-limiting examples, the core 11 may further comprise one or more magnetic materials, where the one or more electrically insulating and non-magnetic materials are disposed around the one or more respective magnetic materials.

Figure 5:
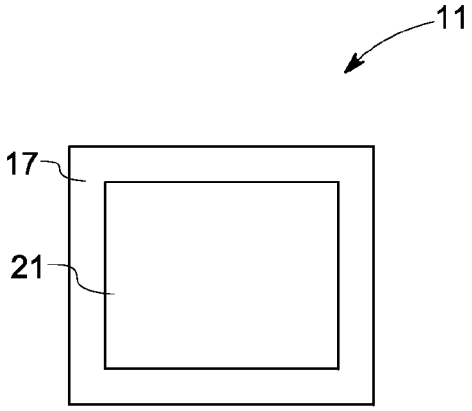
FIGS. 5-6 are schematic cross sectional views illustrating two configurations of a core of the magnetic component.
Figure 6:
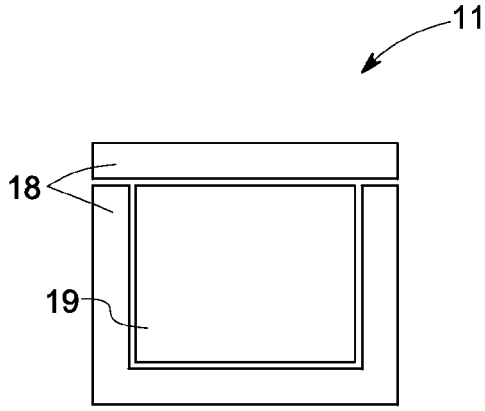

FIGS. 5-6 are schematic cross sectional views illustrating two configurations of the core 11. For ease of illustration, one magnetic element 19 or 21 and one electrically insulating and non-magnetic element 17 or 18 are illustrated.

For the arrangement depicted in FIG. 5, the core 11 comprises the magnetic element 19, and the electrically insulating and non-magnetic element 17 disposed around the magnetic element 19. Thus, the conductor 12 may be disposed around the element 17 so as not to directly contact the magnetic element 19. Similarly, the ridge 20 (shown in FIGS. 2-4) may be disposed on the element 17 for formation of the insulating gap 13 during fabrication of the magnetic component. Additionally, the element 17 may be disposed around the magnetic element 16 using any of a variety of techniques, including without limitation, evaporation, tape placement, and hand lay up.

In other examples, as depicted in FIG. 6, the core 11 comprises the containment element 18 defining a chamber (not labeled) and the magnetic element 21 disposed within the chamber of the containment element 18. Thus, the conductor 12 may be disposed around the containment element 18 so as not to directly contact the magnetic element 21, and the ridge 20 may be disposed around surface(s) of the containment element 18 for formation of the insulating gap 13 during fabrication of the magnetic component.

It should be noted that the arrangements in FIGS. 5 and 6 are merely illustrative. In certain examples, more than one ridge may be disposed on the element 17 or the containment element 18 for formation of more than one continuous conductor and more than one insulating gap.

In the illustrated examples, the element 17 and the containment element 18 may comprise electrically insulating and non-magnetic materials, such as polymers and ceramics. The magnetic elements 19, 21 may comprise magnetic materials, such as a ferrite. In one non-limiting example, the ferrite comprises nickel zinc ferrite.

In other applications, the magnetic material may comprise a nano-crystalline alloy and/or a crystalline alloy. Non-limiting examples of the nano-crystalline alloys include iron-based nano-crystalline alloys, iron-cobalt-based nano-crystalline alloys, iron-silicon based nano-crystalline alloys and combinations thereof. Non-limiting examples of the crystalline alloys include silicon steel, permendur and combinations thereof.

Figure 7:
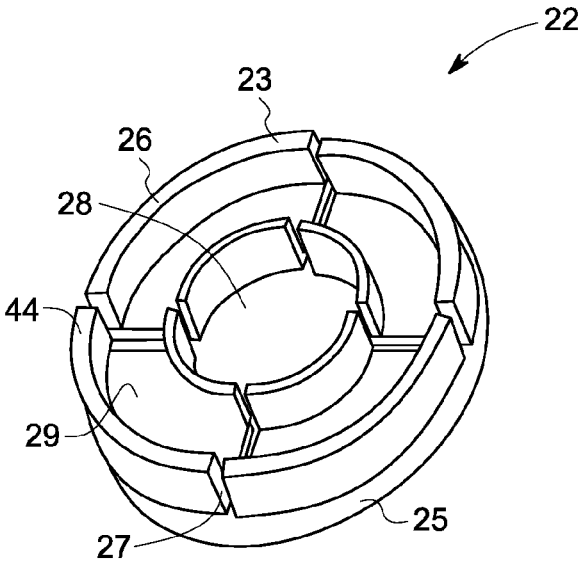
FIG. 7 is a schematic diagram of a first part of the magnetic component in accordance with one embodiment of the invention.
Figure 8:
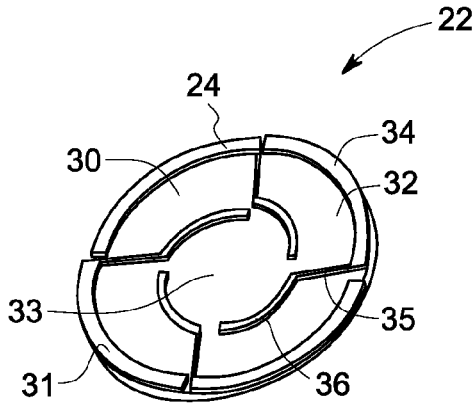
FIG. 8 is a schematic diagram of a second part of the magnetic component of FIG. 7.

In certain embodiments, the magnetic component may not comprise a core, which may be referred to as a "nonmagnetic core" magnetic component. One non-limiting example of a nonmagnetic core is an air-core. FIGS. 7 and 8 are schematic diagrams of a first part 23 and a second part 24 cooperated with the first part 23 of a "nonmagnetic core" magnetic component 22.

As illustrated in FIG. 7, the first part 23 of the magnetic component 22 comprises a first substrate 25, multiple first electrically insulated conductors 26 disposed on an upper surface (not labeled) of the first substrate 25, and multiple first insulating gaps 27 defined between the neighboring conductors 26 for electrical insulation.

In the example illustrated in FIG. 7, the multiple electrically insulated conductors 26 cooperate to form a toroidal configuration with a central hole 28. The first part 23 further defines a recess 29 extending down from upper surfaces (not labeled) of the respective multiple conductors 26. In the illustrated example, each of the first conductors 26 has a substantial U-shaped cross section. Alternatively, each of the first conductors 26 may have other cross sections.

For the arrangement illustrated in FIG. 8, the second part 24 comprises a second substrate 30, multiple second electrically insulated conductors 31 disposed on an upper surface (not labeled) of the second substrate 30, and multiple second insulating gaps 32 defined between the neighboring conductors 31 for insulation. In non-limiting examples, the first substrate 25 may comprise an electrically insulating material and wherein the second substrate 30 may comprise a printed circuit board.

In the example illustrated in FIG. 8, the multiple second electrically insulated conductors 31 also cooperate to form a toroidal configuration with a central hole 33 passing through. Each of the second conductors 31 has a plate shape, and comprises a first portion 34, a second portion 36, and a connection portion 35 connecting the first portion 34 and the second portion 36.

Alternatively, each of the second conductors 31 may have other shapes. For example, the upper surfaces (not labeled) of the first and second portions may be higher than an upper surface of the connection portion 36 so as to define a second recess (not shown) to mate with the first conductors 26 defining the recess 29. In other applications, the first conductors 26 may have a planar shape to mate with the respective conductors 31 having upper surfaces with different heights.

It should be noted that the arrangements illustrated in FIGS. 7 and 8 are merely illustrative. In some examples, at least two first electrically insulated conductors may be employed, and at least one first insulating gap may be defined between the neighboring conductors. At least one second electrically insulated conductors may be employed, and the second insulating gap may not be employed. In certain applications, the central holes 28 and/or 33 may also not be formed.

In addition, in the examples illustrated in FIGS. 7 and 8, the first and second conductors are disposed on the same respective first and second substrates. In some applications, the two or more first conductors and/or the one or more second conductors may be disposed on one or more respective first and/or second substrates.

Figure 9:
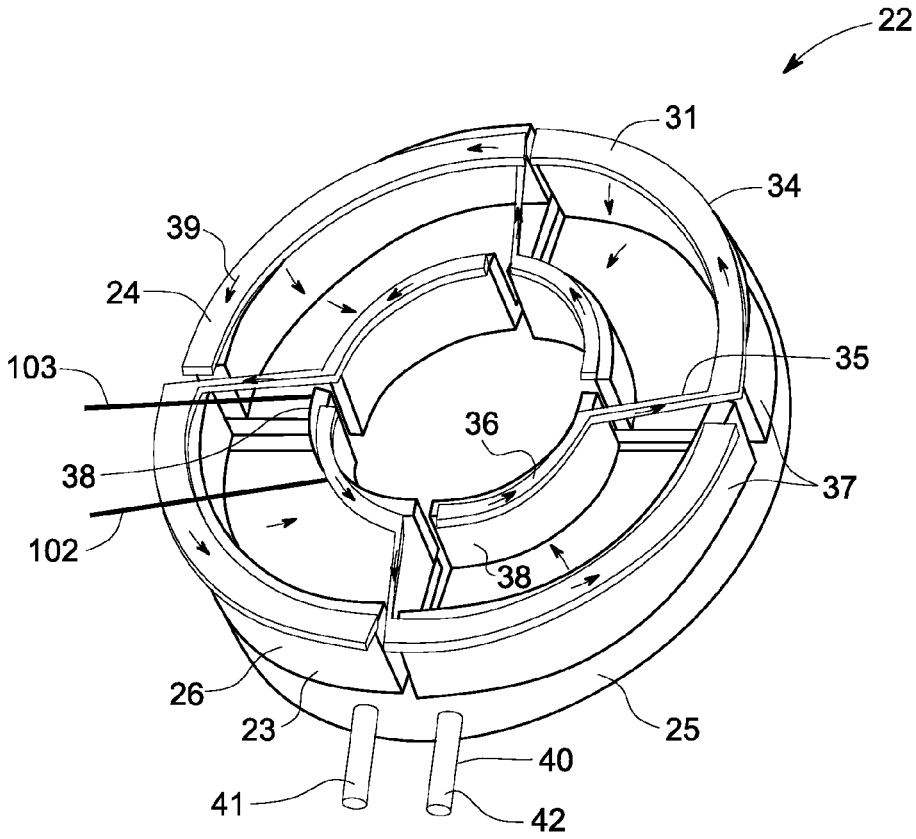
FIG. 9 is a schematic assembled diagram of the first and second parts of the magnetic component shown in FIGS. 7 and 8.

FIG. 9 is a schematic assembled diagram of the first and second parts 23 and 24 of the magnetic component 22. For ease of illustration, the second substrate 30 of the second part 24 is not illustrated. It should be noted the arrangements illustrated in FIG. 9-16 are merely illustrative. The same numerals in FIGS. 7-16 may indicate similar elements.

As illustrated in FIG. 9, during assembly, the first substrate 25 is mated with the second substrate 30, so that each of the one or more second conductors 31 electrically connects respective adjacent ones of the first conductors 26 to one another to form one or more continuous wound conductors around a nonmagnetic core to form the magnetic component 22.

For example, the first and second portions 34, 36 of a second conductor 31 electrically connect ends 37, 38 of adjacent first electrically insulated conductors 26 respectively, which are positioned at different sides of the recess 29. The connection portion 35 electrically connects the first and second portions 34, 36 so as to form one or more continuous wound conductors. Each continuous wound conductor may comprise one or more continuous turns.

For the arrangement illustrated in FIG. 9, a positive terminal 102 and a negative terminal 103 are provided to connect an electrical circuit (not shown) to two ends of one continuous conductor of the magnetic component 22 so as to pass an electrical current through the first and second conductors 26, 31. Alternatively, where multiple continuous conductors are provided, multiple sets of positive and negative terminals may be provided for electrical connection to the ends of the respective continuous conductors.

In the illustrated example, the positive terminal 102 and the negative terminal 103 are electrically connected to the second portion 36 of the second conductor 31 and to the end 38 of the first conductor 26, respectively, to pass an electrical current into and out of the magnetic component 22. For the illustrated example, the electrical current is delivered along the direction indicated by arrows 39.

One or more electrical insulation materials (not shown) may be provided between the second portion 36 connected to the positive terminal 102 and the end 38 connected to the negative terminal 103 for electrical insulation. Non-limiting examples of the electrical insulating materials include polymers, ceramics, air, Teflon®, epoxy and glass-epoxy composites, and combinations thereof.

In other examples, the end 38 may be electrically connected to the positive terminal 102 and the second portion 36 may be electrically connected to the negative terminal 103. Alternatively, the first portion 34 and the corresponding end 37 may be employed to electrically connect to the respective positive and negative terminals with one or more electrically insulation materials being provided therebetween.

In certain applications, the first conductors 26 or the second conductors 31 may be employed to deliver the electrical current both into and out of the magnetic component 22. For example, a pair of second conductors 31 may be mated with three first conductors 26, such that the electrical current may pass both into and out of the magnetic component 22 through the first conductors 26.

In some applications, as illustrated in FIG. 9, the magnetic component 22 further comprises a cooling device 40 coupled to the first substrate 25 for cooling the magnetic component 22. The first substrate 25 may define one or more passages (not shown) in fluid communication with each other. In certain applications, the cooling device 40 may or may not be coupled to the second substrate 30 for cooling.

For the illustrated example, the cooling device 40 comprises an inlet pipe 41 and an outlet pipe 42 configured to be in fluid communication with the one or more passages within the first substrate 25 and/or the second substrate 30. Thus, a fluid from a fluid source (not shown) may be circulated through the inlet pipe 41, the one or more passages, and the outlet pipe 42 for cooling the magnetic component 22.

In the example illustrated in FIG. 9, the magnetic component 22 has a nonmagnetic-core. In some non-limiting examples, as illustrated in FIG. 10, the magnetic component 22 may comprise a magnetic element 43 accommodated into the recess 29 (shown in FIG. 7) of the first conductors 26 so as to be located between the first conductors 26 and the second conductors 31.

Figure 10:
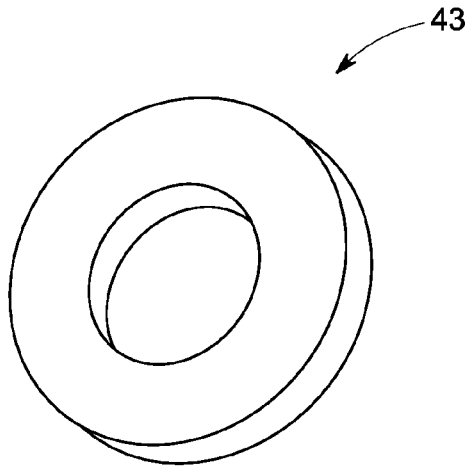
FIG. 10 is a schematic diagram of a magnetic element.

In the example depicted in FIG. 10, the magnetic element 43 has a toroidal shape to be accommodated into the recess 29. In other examples, the magnetic element 43 may have any other suitable shape so as to be accommodated between the first conductors and the second conductors. Alternatively, a magnetic element 43 may not be employed.

In some applications, the magnetic element 43 may comprise one or more magnetic materials. The magnetic component 22 may further comprise one or more electrically insulating and non-magnetic materials disposed around the magnetic element 43 prior to accommodation of the magnetic element 43 between the first and second conductors.

Figure 11:
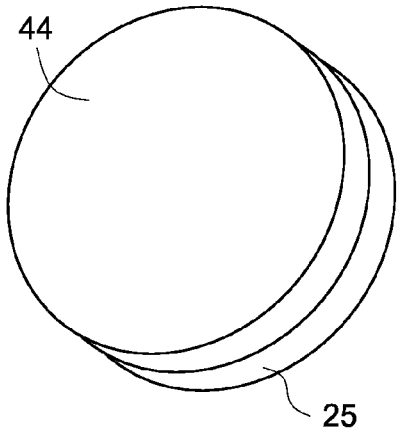
FIGS. 11-13 are schematic diagrams illustrating fabrication of first electrically insulated conductors of the first part of the magnetic component shown in FIGS. 7-10.
Figure 12:
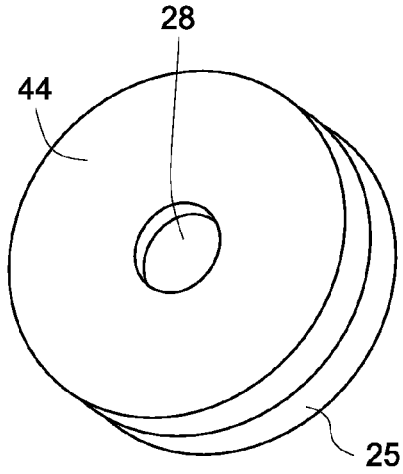
Figure 13:
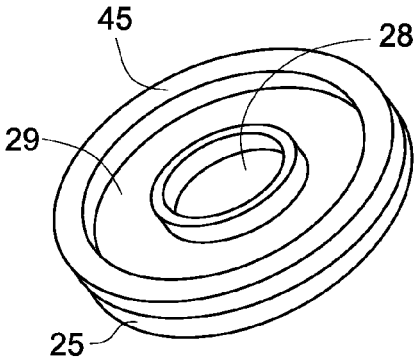

FIGS. 11-13 are schematic diagrams illustrating fabrication of the first electrically insulated conductors 26. As illustrated in FIG. 11, the first substrate 25 is provided and one or more first electrically conductive materials (serving as a conductor) are provided to form a first electrically conductive layer 44 on the substrate 25. In certain applications, when more than one substrate 25 is provided, more than one first layer 44 may be formed. Then, as illustrated in FIG. 12, the central hole 28 is defined to extend through the first layer 44.

In some examples, the first substrate 25 may also be formed with a through hole (not labeled) so as to be stacked with the central hole 28 before the first layer 44 is disposed on the first substrate 25.

Subsequently, as illustrated in FIG. 13, the recess 29 extends down from an upper surface 45 of the first substrate 25. Finally, as illustrated in FIG. 7, multiple portions of the first layer 44 are removed to define multiple insulating gaps 27 so as to segment the first layer 44 into the multiple electrically insulated conductors 26.

It should be noted that the arrangements in FIGS. 11-13 are merely illustrative. In some applications, the first layer 44 defining the recess 29 may be first fabricated. Then, the first layer 44 defining the recess 29 may be adhered on the first substrate 25. Thus, the fabrication step illustrated in FIG. 11 may not be employed. Subsequently, multiple portions of the first layer 44 defining the recess 29 are removed to define multiple insulating gaps 27 so as to segment the first layer 44 into the multiple electrically insulated conductors 26. In other applications, the multiple electrically insulated conductors 26 may be fabricated before being attached on the first substrate 25.

Figure 14:
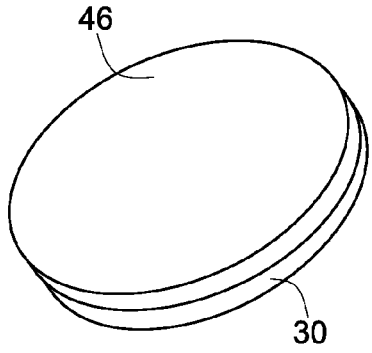
FIG. 14 is a schematic diagram illustrating fabrication of second electrically insulated conductors of the second part of the magnetic component shown in FIGS. 7-10.

Additionally, during fabrication of the second conductors 31, as illustrated in FIG. 14, the second substrate 30 is provided and the one or more second electrically conductive materials are provided to form a second electrically conductive layer 46 on the second substrate 30.

Then, as illustrated in FIG. 8, multiple portions of the second layer 46 are removed in desired patterns to define multiple insulating gaps 32 so as to form the multiple electrically insulated second conductors 31. For some arrangements, the second substrate 30 may be also formed with a through hole (not labeled) so as to be stacked with the central hole 33. Similarly, in certain applications, the multiple electrically insulated second conductors 31 may be attached onto the second substrate 30 after fabrication.

In certain applications, at least two first conductors and/or at least one second conductor may be formed on the respective first and/or second substrates. One or more of the holes 28, 33 and the through holes on the first and second substrates may or may not be defined. Additionally, the first and/or second substrates may define respective one or more passages to be in fluid communication with one or more cooling devices 40 when the one or more cooling devices 40 are employed.

It should be noted that the order of some of the steps for fabrication of the magnetic component 22 may be changed. In one example, the order of the steps for providing the first and second substrates can be reversed.

Additionally, in the examples illustrated in FIGS. 7-14, the first and second conductors 26, 31 are formed after the one or more first and second electrically conductive materials are disposed on the respective substrates. In some applications, the first and second conductors 26, 31 may be disposed on the first and/or second substrates 25, 30 after being fabricated in desired patterns.

Accordingly, in non-limiting examples, the one or more first and/or second electrically conductive materials may be disposed on the respective first and/or second substrate to directly form the first and/or second continuous conductors without the removal of the one or more portions of the one or more first and/or second electrically conductive materials.

In some applications, the first layer 44 and/or the second layer 46 may be treated using a variety of techniques including, without limitation, molding, photolithography, machining and other suitable techniques to form the first and/or second electrically insulated conductors 26, 31 with desired patterns.

Figure 15:
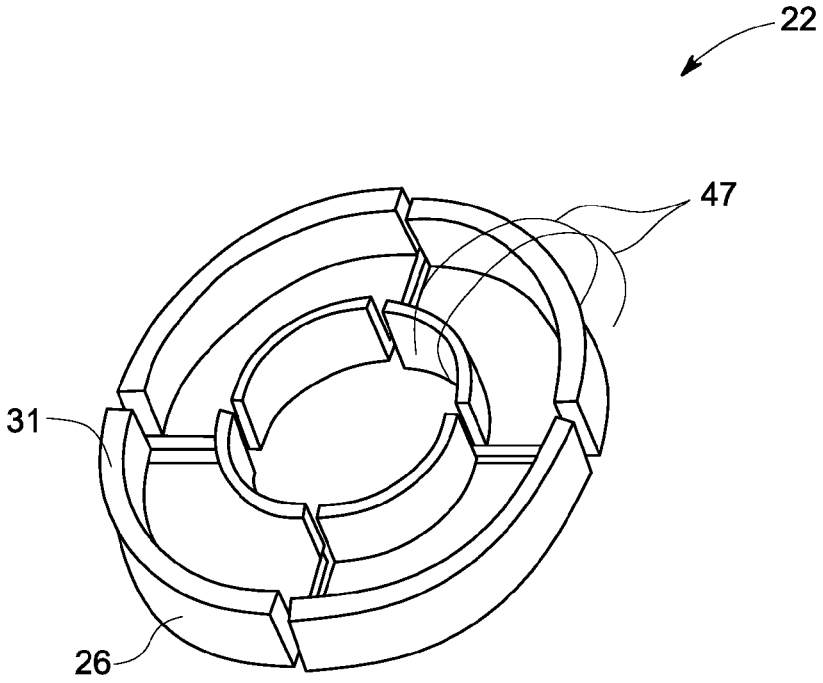
FIG. 15 is a schematic diagram of the magnetic component shown in FIGS. 7-10 with a wire conductor wound thereon.

For certain arrangements, as illustrated in FIG. 15, one or more wire conductors 47 may be wound around the magnetic component 22 each including at least one turn so as to form one or more continuous conductors wound around the magnetic component 22, which may act as a core.

It should be noted the arrangement in FIG. 15 is merely illustrative. For ease of illustration, the first and the second substrates are not illustrated and the magnetic element may or may not be employed.

In certain applications, one or more electrically insulating and non-magnetic materials may be disposed around the one or more wire conductors for electrical insulation before the one or more wire conductors 56 are wound around the magnetic component 22.

For the arrangements illustrated in FIGS. 7-15, the first and second substrates 25, 30 are planar. In some examples, the first and/or second substrate 25, may have other shapes, such as toroidal shapes.

Figure 16:
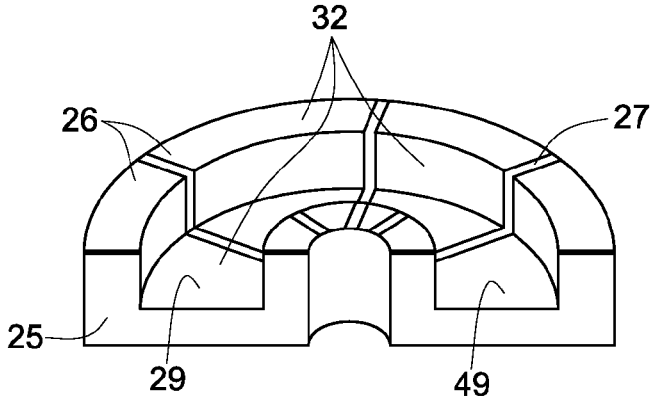
FIG. 16 is a schematic cross sectional view of a first substrate of the first part of the magnetic component in accordance with another embodiment of the invention.

FIG. 16 is a schematic cross sectional view of the first substrate 25 in accordance with another embodiment of the invention. It should be noted the arrangement in FIG. 16 is merely illustrative. For ease of illustration, a schematic cross sectional view of the first substrate 25 is illustrated.

As illustrated in FIG. 16, the first substrate 25 has a toroidal shape with a U-shaped cross section, and comprises an upper surface 48, a bottom surface (not shown), and outer and inner side surface (not labeled). A first recess 49 extends down from the upper surface 48 of the first substrate 25.

In some examples, the first substrate 25 may have other shapes, such as a rectangular shape or an arc shape, with or without a recess defined thereon. Additionally, the first substrate 25 may have other cross sections, such as a cylindrical cross section.

Thus, during fabrication of the first conductors 26, one or more first electrically conductive materials (served as curved first conductors) may be disposed at least on the first recess 49 of the first substrate 25. Next, one or more portions of the one or more first electrically conductive materials may be removed in a desired pattern, so that a plurality of first electrically insulated conductors 26 and one or more insulating gaps 27 may be formed on the toroidal substrate 23, which may have a similar configuration as the arrangement illustrated in FIG. 7. The recess 29 is defined by the first conductors 26.

In one non-limiting example, the recess 29 and the curved first electrical conductors 26 may be U-shaped, and the curved first electrical conductors 26 may be selectively disposed using a pick and place or self-assembly technique. In certain applications, the curved first electrically conductors 26 may be adhered on the first substrate 25 after being fabricated. In non-limiting examples, the first conductors 26 may be stamped on the first substrate 25.

In some applications, similar to the arrangements illustrated in FIGS. 1-4, one or more ridges may be employed for forming the first electrically insulated conductors 26 and the one or more insulating gaps 27.

In other examples, the second substrate 30 may have a similar configuration as the first substrate 25 in FIG. 16, so that the second substrate 30 may also have a toroidal shape, and may or may not define a second recess (not shown) thereon. In one example, a second recess is defined on the second substrate 30. In certain applications, the second substrate 30 may have other shapes suitable to facilitate mating the first and second conductors to form the magnetic component 22 in the absence of a core.

Accordingly, during fabrication of the second conductors 31, one or more second electrically conductive materials (served as one or more second conductors) are disposed on the second toroidal substrate 30. Next, one or more portions of the second electrically conductive material(s) may be removed in a desired pattern to form the one or more insulating gaps 32 and the one or more second conductors 31, which may have a similar planar view as the configuration illustrated in FIG. 8. Similarly, in certain applications, the second electrically conductors 31 may be first fabricated, and then be adhered on the second substrate 30. In non-limiting examples, the second conductors 31 may be stamped on the second substrate 30.

In some applications, the first substrate having any of a variety of configurations may be mated with the second substrate having any of a variety of configurations so as to form the nonmagnetic core magnetic component with one or more continuous conductors. In the embodiments of the invention, the magnetic components have a higher quality factor "Q" and lower flux leakage, and the cost for fabrication of such magnetic components is lower.

While the disclosure has been illustrated and described in typical embodiments, it is not intended to be limited to the details shown, since various modifications and substitutions can be made without departing in any way from the spirit of the present disclosure. As such, further modifications and equivalents of the disclosure herein disclosed may occur to persons skilled in the art using no more than routine experimentation, and all such modifications and equivalents are believed to be through the spirit and scope of the disclosure as defined by the subsequent claims.

What is claimed is:

1. A method for making a magnetic component, the method comprising:

providing one or more first substrates;

disposing one or more first electrically conductive materials on the one or more first substrates to form a plurality of first electrically insulated conductors on the one or more first substrates;

providing one or more second substrates;

disposing one or more second electrically conductive materials on the one or more second substrates to form one or more second electrically insulated conductors on the one or more second substrates;

mating the one or more second substrates with the respective one or more first substrates, so that each of the one or more second conductors electrically connects respective adjacent ones of the plurality of the first electrically insulated conductors to one another to form one or more continuous wound conductors; and providing one or more cooling devices coupled to one or more of the first and second substrates for cooling.

2. The method of claim 1, wherein the one or more wound continuous conductors are wound around a nonmagnetic core.

3. The method of claim 1, further comprising forming a recess extending down from an upper surface of one or more layers formed by disposing the one or more first electrically conductive materials on the one or more first substrates.

4. The method of claim 3, further comprising:

removing one or more portions of the one or more first electrically conductive materials to form the first electrically insulated conductors after forming the recess on the one or more first layers; and removing one or more portions of the one or more second electrically conductive materials to form the one or more second electrically insulated conductors, wherein the removal steps are performed prior to the step of mating the first and second substrates.

5. The method of claim 1, wherein at least one of the first and second substrates are plate shaped.

6. The method of claim 1, wherein one or more of the first and second substrates define one or more recesses, so that at least one of the plurality of the first electrically insulated conductors and the one or more second electrically insulated conductors extend within a respective one of the one or more recesses.

7. A method for making a magnetic component, the method comprising:

providing one or more first substrates;

disposing one or more first electrically conductive materials on the one or more first substrates to form a plurality of first electrically insulated conductors on the one or more first substrates;

forming a recess extending down from an upper surface of one or more layers formed by disposing the one or more first electrically conductive materials on the one or more first substrates;

providing one or more second substrates;

disposing one or more second electrically conductive materials on the one or more second substrates to form one or more second electrically insulated conductors on the one or more second substrates; and mating the one or more second substrates with the respective one or more first substrates, so that the one or more second conductors electrically connect respective adjacent ones of the first electrically insulated conductors to one another to form one or more continuous wound conductors.

8. The method of claim 7, further comprising:

removing one or more portions of the one or more first electrically conductive materials to form the first electrically insulated conductors after forming the recess on the one or more first layers; and removing one or more portions of the one or more second electrically conductive materials to form the one or more second electrically insulated conductors, wherein the removal steps are performed prior to the step of mating the first and second substrates.

9. The method of claim 7, wherein each of the one or more second conductors electrically connects respective adjacent ones of the first electrically insulated conductors to one another to form one or more continuous wound conductors.

10. The method of claim 7, wherein the one or more wound continuous conductors are wound around a nonmagnetic core.

11. The method of claim 7, wherein at least one of the first and second substrates are plate shaped.

12. A method for making a magnetic component, the method comprising:

providing one or more first substrates;

disposing one or more first electrically conductive materials on the one or more first substrates to form a plurality of first electrically insulated conductors on the one or more first substrates;

providing one or more second substrates;

disposing one or more second electrically conductive materials on the one or more second substrates to form one or more second electrically insulated conductors on the one or more second substrates; and mating the one or more second substrates with the respective one or more first substrates, so that the one or more second conductors electrically connect respective adjacent ones of the first electrically insulated conductors to one another to form one or more continuous wound conductors, wherein one or more of the first and second substrates define one or more recesses so that at least one of the plurality of the first electrically insulated conductors and the one or more second electrically insulated conductors extend within a respective one of the one or more recesses.

13. The method of claim 12, wherein each of the one or more second conductors electrically connects respective adjacent ones of the first electrically insulated conductors to one another to form one or more continuous wound conductors.

14. The method of claim 12, wherein the one or more wound continuous conductors are wound around a nonmagnetic core.

15. The method of claim 12, wherein at least one of the first and second substrates are plate shaped.

* * * * *